US010751260B2

(12) United States Patent
Mayer et al.

(10) Patent No.: US 10,751,260 B2
(45) Date of Patent: Aug. 25, 2020

(54) DISPENSER

(71) Applicant: JAG MAYER PTY LTD, Doncaster East (AU)

(72) Inventors: Julie-Anne Mayer, Doncaster East (AU); Glen Mayer, Doncaster East (AU); Allan James Hooworth, Kew (AU); Michael Edward Philip Russell, Prahran (AU)

(73) Assignee: JAG MAYER PTY LTD, Doncaster East (AU)

( * ) Notice: Subject to any disclaimer, the term of this patent is extended or adjusted under 35 U.S.C. 154(b) by 808 days.

(21) Appl. No.: 15/031,039

(22) PCT Filed: Oct. 22, 2014

(86) PCT No.: PCT/US2014/001002
§ 371 (c)(1),
(2) Date: Apr. 21, 2016

(87) PCT Pub. No.: WO2015/058244
PCT Pub. Date: Apr. 30, 2015

(65) Prior Publication Data

US 2018/0214349 A1 Aug. 2, 2018

(30) Foreign Application Priority Data

Oct. 22, 2013 (AU) ..... 2013101385
Oct. 22, 2013 (AU) ..... 2013904071

(51) Int. Cl.
*A61J 9/04* (2006.01)
*A61J 11/00* (2006.01)
(Continued)

(52) U.S. Cl.
CPC ..... *A61J 9/04* (2013.01); *A47G 19/2272* (2013.01); *A61J 9/001* (2013.01); *A61J 9/008* (2013.01);
(Continued)

(58) Field of Classification Search
CPC .... A61J 9/04; A61J 9/001; A61J 9/008; A61J 9/085; A61J 11/0015; A61J 11/008;
(Continued)

(56) References Cited

U.S. PATENT DOCUMENTS 1,649,580 A 11/1927 Geisler
2,088,770 A * 8/1937 Skinner ..... E21B 10/26 175/406
(Continued)

FOREIGN PATENT DOCUMENTS

CN 2151747 Y 1/1994
EP 2011467 A1 1/2009
(Continued)

*Primary Examiner* — Tri M Mai
(74) *Attorney, Agent, or Firm* — Eversheds Sutherland (US) LLP

(57) ABSTRACT

A kit of parts for a feeder has a body and a bung that can slide within the body. A periphery of the bung can form a sliding seal between that periphery and the internal side walls of the body. A base cap has an aperture and is mountable at a lower end of the body to substantially occlude that end and allow airflow through the aperture into the body as the bung moves away. The kit has a teat mouthpiece for liquid foods, a sipper mouthpiece for pureed food, and a spout mouthpiece for mashed food and a pump attachment. The pump attachment has a pump and a spoon. The pump has a pump bung which moves reciprocatingly within the body and forms a sliding seal with the internal side walls. A valve allows food to flow from the feeder but prevents the flow of food into the feeder.

19 Claims, 8 Drawing Sheets

(51) Int. Cl.

| | |
|---|---|
| ***A47G 19/22*** | (2006.01) |
| ***A61J 9/08*** | (2006.01) |
| ***A61J 9/00*** | (2006.01) |
| ***A61J 7/00*** | (2006.01) |

(52) U.S. Cl.
CPC ..... *A61J 9/085* (2013.01); *A61J 11/008* (2013.01); *A61J 11/0015* (2013.01); *A61J 11/0085* (2013.01); *A61J 7/0023* (2013.01); *A61J 2200/76* (2013.01)

(58) Field of Classification Search
CPC .. A61J 11/0085; A61J 7/0023; A61J 2200/76; A47G 19/2272
See application file for complete search history.

(56) References Cited

U.S. PATENT DOCUMENTS 3,076,574 A * 2/1963 Woodbury, Jr. ..... A61J 9/00 215/11.1
3,093,256 A 5/1963 Woodbury
3,108,721 A 10/1963 Nebinger
3,164,303 A * 1/1965 Trautmann ..... A61M 3/005 222/136
4,010,861 A * 3/1977 Welten ..... A61J 9/04 215/11.5
4,339,046 A * 7/1982 Coen ..... A61J 9/001 215/11.3
4,691,847 A 9/1987 Ford et al.
4,894,220 A 1/1990 Nabi et al.
5,032,386 A 7/1991 Gaffar et al.
5,037,635 A 8/1991 Nabi et al.
5,037,637 A 8/1991 Gaffar et al.
5,043,154 A 8/1991 Gaffar et al.
5,080,887 A 1/1992 Gaffar et al.
5,135,738 A 8/1992 Gaffar et al.
5,156,835 A 10/1992 Nabi et al.
5,167,951 A 12/1992 Gaffar et al.
5,178,851 A 1/1993 Gaffar et al.
5,180,578 A 1/1993 Gaffar et al.
5,188,821 A 2/1993 Gaffar et al.
5,192,530 A 3/1993 Gaffar et al.
5,192,531 A 3/1993 Gaffar et al.
5,202,112 A 4/1993 Prencipe et al.
5,234,688 A 8/1993 Gaffar
5,256,401 A 10/1993 Duckenfield et al.
5,260,062 A 11/1993 Gaffar
5,269,426 A 12/1993 Morano
5,273,741 A 12/1993 Gaffar et al.
5,279,813 A 1/1994 Gaffar et al.
5,288,480 A 2/1994 Gaffar et al.
5,294,431 A 3/1994 Gaffar et al.
5,296,214 A 3/1994 Gaffar
5,292,526 A 4/1994 Gaffar et al.
5,300,283 A 4/1994 Prencipe et al.
5,312,618 A 5/1994 Gaffar et al.
5,334,375 A 8/1994 Nabi et al.
5,344,641 A 9/1994 Gaffar et al.
5,385,729 A 1/1995 Prencipe et al.
5,424,059 A 6/1995 Prencipe et al.
5,453,265 A 9/1995 Gaffar et al.
5,466,437 A 11/1995 Gaffar et al.
5,496,540 A 3/1996 Gaffar et al.
5,531,982 A 7/1996 Gaffar et al.
5,538,715 A 7/1996 Gaffar et al.
5,575,652 A 11/1996 Gaffar et al.
5,686,064 A 11/1997 Gaffar et al.
5,728,756 A 3/1998 Gaffar et al.
5,776,435 A 7/1998 Gaffar et al.
6,136,298 A 10/2000 Gaffar et al.
6,138,710 A 10/2000 Chomik et al.
6,138,848 A * 10/2000 Fermo ..... A61J 9/00 215/11.1
6,645,228 B2 11/2003 Renz
7,122,045 B2 10/2006 Randolph et al.
7,163,113 B2 1/2007 Manganiello et al.
7,195,136 B2 3/2007 von Schuckmann
7,326,234 B2 * 2/2008 Lieberman ..... A61J 9/04 215/11.5
7,367,476 B2 5/2008 Law et al.
7,654,418 B2 2/2010 Law et al.
7,658,294 B2 * 2/2010 Housley ..... A61J 9/04 215/11.1
7,669,725 B2 3/2010 Randolph et al.
7,828,821 B2 11/2010 Renz
7,891,522 B2 2/2011 Law et al.
8,136,703 B2 3/2012 Kamishita
8,172,874 B2 5/2012 Randolph et al.
8,397,926 B2 * 3/2013 Driver ..... A61J 9/001 215/11.1
8,727,147 B2 * 5/2014 Kemper ..... A61J 9/04 215/11.1
8,771,711 B2 7/2014 Kamishita
10,226,402 B2 * 3/2019 Berkovitch ..... A61J 9/04
2002/0050481 A1 5/2002 Manganiello et al.
2003/0093120 A1 5/2003 Renz
2003/0093121 A1 5/2003 Randolph
2005/0035078 A1 2/2005 Lieberman et al.
2005/0056610 A1 3/2005 Randolph et al.
2005/0060553 A1 3/2005 Allen
2005/0247658 A1 11/2005 Renz
2005/0277987 A1 12/2005 Randolph et al.
2006/0043117 A1 3/2006 Law et al.
2006/0043118 A1 3/2006 Law et al.
2006/0097014 A1 5/2006 Von Schuckmann
2008/0197149 A1 8/2008 Law et al.
2008/0251486 A1 10/2008 Housley et al.
2009/0275668 A1 11/2009 Kamishita
2009/0289083 A1 11/2009 Kamishita
2010/0102019 A1 4/2010 Randolph et al.
2010/0193459 A1 8/2010 Housley
2012/0221046 A1 8/2012 Randolph et al.
2014/0228882 A1 8/2014 Randolph et al.

FOREIGN PATENT DOCUMENTS

WO 1995/004690 A1 2/1995
WO WO-2004002397 A1 * 1/2004 ..... A61J 9/04

* cited by examiner

DISPENSER

RELATED APPLICATIONS

This application claims priority to Australian Provisional Patent Application No. 2013904071 in the name of JAG Mayer Pty Ltd, which was filed on 22 Oct. 2013, entitled "A Dispenser" and to Australian Innovation Patent No. 2013101385 in the name of JAG Mayer Pty Ltd, which was filed on 22 Oct. 2013, entitled "A Dispenser" and the specifications thereof are incorporated herein by reference in their entirety and for all purposes.

FIELD OF THE INVENTION

The present invention relates to bottles and like containers which are suitable for use as feeders. It is particularly suitable for the feeding of infants and of people who are suffering from disabilities, such as, persons who are recovering from facial or dental surgery and the incapacitated elderly, however, it should be appreciated that the present invention is not limited to that use, only. For example, embodiments of the present invention are also suitable for use as dispensers of material other than foods.

BACKGROUND OF THE INVENTION

Common problems at infant feeding time are the mess created, the wasted food and the time spent cleaning up. There is a need for a re-usable feeding dispenser that is non-spill, easy to fill and easy to clean. Parents also need a container that they can give to toddlers so that they can feed themselves independently.

Single-use packaging for ready to eat baby foods are accordingly a popular choice for today's parents. A trip down the baby/toddler aisle at the supermarket will confirm this by the sheer numbers of brands and the different types of foods being offered in these packages. Yoghurts, smoothies, fruit jellies, porridge, bolognese, creamy chicken and vegetable purees are just a few of the ready-to-eat meals and snacks that are being offered in these single use packages.

More recently, re-usable squeezable silicone type containers have entered the marketplace giving parents the option of feeding their children homemade meals in transportable feeding dispensers. However the solution provided by these dispensers is in itself flawed. The inability to empty the entire contents out of these containers is both frustrating and wasteful. Also toddlers are able to create a mess when given these containers by excessively squeezing the food out onto themselves and onto their environment, such as the floor, walls car seats and the like.

It is an object of the embodiments described herein to overcome or alleviate at least one of the above noted drawbacks of related art systems or to at least provide a useful alternative to related art systems.

SUMMARY OF THE INVENTION

In contrast to any related or prior art noted herein, in one aspect, embodiments of the present invention provide a kit of parts for a dispenser of material, comprising:

- a tubular body of substantially invariant internal cross-sectional shape;
- a bung which:
  - is adapted to slide within the tubular body; and

- has a periphery which is adapted to form a sliding seal between that periphery and the internal side walls of the tubular body; and
- a base cap having an aperture through it, the base cap being adapted:
  - for mounting at a first end of the tubular body so as to substantially occlude that end; and
  - to allow airflow through the aperture into the tubular body as the bung moves in a direction away from the first end of the tubular body.

It is preferred that the material is food or drink.

It is preferred that the kit of parts further comprise at least one mouthpiece attachment which is adapted for readily-detachable mounting to a second end of the tubular body.

It is preferred that the kit of parts further comprise a pump attachment, the pump attachment comprising a pump which is adapted for readily-detachable mounting to the second end of the tubular body and which is adapted to pump material out of the tubular body.

It is preferred that the pump attachment further comprise a spoon which is mounted on the pump attachment and which is adapted to receive material which the pump pumps out of the tubular body.

It is preferred that the kit of parts further comprise a top cap which is mountable to the dispenser to cover at least one of a mouthpiece attachment and the pump attachment.

It is preferred that the kit of parts further comprise a valve which is mountable in the dispenser to permit airflow only in the direction from the exterior of the tubular body to the interior of the tubular body.

It is preferred that the kit of parts further comprise a valve which is mountable at the second end of the tubular body so as to permit the flow of material only in the direction from the interior of the tubular body to the exterior of the tubular body.

It is preferred that the valve to permit the flow of material only in the direction from the interior of the tubular body is weaker than is the valve to permit airflow only in the direction from the exterior of the tubular body.

It is preferred that the tubular body is substantially circular in internal cross-section.

It is preferred that the periphery which is adapted to form the sliding seal comprises at least one of:

- a radially-extending circumferential seal;
- a radially-extending scraping and sealing blade; and
- a radially-extending locating and alignment ring which is located between the radially-extending circumferential seal and the radially-extending locating and alignment ring.

It is preferred that the radially-extending circumferential seal is formed separately from the bung.

It is preferred that at least one of:

the radially-extending scraping and sealing blade; and the radially-extending locating and alignment ring is formed integrally with the hung.

It is preferred that the base cap is adapted to serve as a mounting for the top cap so as not to substantially occlude the airflow through the aperture into the tubular body.

It is preferred that the base cap comprises:

- a central body, the periphery of which carries longitudinally-running channels; and
- an outer peripheral skirt which surrounds the periphery of the central body, the base cap being adapted to receive a peripheral edge of the top cap between the longitudinally-running channels and the outer peripheral skirt.

It is preferred that the at least one mouthpiece attachment is one of:

a teat mouthpiece which is adapted to allow the flow of a liquid through it;

a sipper mouthpiece which is adapted to allow the flow of pureed material through it; and a spout mouthpiece which is adapted to allow the flow of mashed material through it.

It is preferred that the sipper mouthpiece comprises a body which has a blunt end which is pierced by a slit in that blunt end.

It is preferred that the body of the sipper mouthpiece is substantially elliptical in cross-section.

It is preferred that the spout mouthpiece comprises:

a base;

an open-ended spout which extends from the base; and a valve in the base which allows flow of material into the spout.

It is preferred that the pump comprises:

a pump bung which:

is adapted for reciprocating movement along the longitudinal axis of the tubular body; and has a periphery which is adapted to form a sliding seal between that periphery and the internal side walls of the tubular body;

a valve which is adapted to allow the flow of material from the interior of the tubular body as the pump bung moves into the pump body but to prevent the flow of material into the interior of the tubular body as the pump bung moves out of the pump body; and biasing means to bias the pump bung to move in a direction out of the pump body.

It is preferred that the biasing means comprises a helical spring.

It is preferred that the helical spring is mounted in a housing which comprises:

a spring stop relative to which the pump bung is longitudinally moveable; and a spring top cap:

relative to which the pump bung is fixed; and which is reciprocally moveable within the spring stop.

It is preferred that the pump attachment further comprises a pump tube which is adapted to deliver material from the outlet of the a valve which is adapted to allow the flow of material from the interior of the tubular body to the spoon.

It is preferred that the spring stop and the spring top cap are mounted substantially co-axially around the pump tube.

In another aspect, embodiments of the present invention provide a dispenser for the dispensing of material, the dispenser being assembled from the kit of parts which is summarized above.

In another aspect, embodiments of the present invention provide a pump attachment for a dispenser of material comprising a pump which is adapted for mounting to the dispenser, the dispenser comprising a tubular body, the pump attachment being adapted to pump material out of the dispenser.

It is preferred that the pump attachment further comprise a spoon which is mounted on the pump attachment and which is adapted to receive material which the pump pumps out of the dispenser.

It is preferred that the pump comprises:

a pump bung which:

is adapted for reciprocating movement along a longitudinal axis of the tubular body; and has a periphery which is adapted to form a sliding seal between that periphery and internal side walls of the tubular body;

a valve which is adapted to allow the flow of material from the interior of the tubular body as the pump bung moves into the tubular body but to prevent the flow of material into the interior of the tubular body as the pump bung moves out of the tubular body; and biasing means to bias the pump bung to move in a direction out of the tubular body.

It is preferred that the biasing means comprises a helical spring.

It is preferred that the helical spring is mounted in a housing which comprises:

a spring stop relative to which the pump bung is longitudinally moveable; and a spring top cap:

relative to which the pump bung is fixed; and which is reciprocally moveable within the spring stop.

It is preferred that the pump attachment further comprises a pump tube which is adapted to deliver material from the outlet of the a valve which is adapted to allow the flow of material from the interior of the tubular body to the spoon.

It is preferred that the spring stop and the spring top cap are mounted substantially co-axially around the pump tube.

It will be seen that embodiments of the present invention provide a non-squeezable re-usable feeding dispenser, which offers the same benefits as the squeezable dispensers as well as solutions to common wastage problems such as: toddlers excessively squeezing contents from flexible dispensers, the inability to get all of the contents out of the dispensers and spoons and/or bowls being knocked to the floor.

BRIEF DESCRIPTION OF THE DRAWINGS

For a better understanding of the invention, and to show how it may be carried into effect, embodiments of it are shown, by way of non-limiting example only, in the accompanying drawings. In the drawings.

DESCRIPTION OF PREFERRED EMBODIMENTS OF THE INVENTION

Figures 1A, 1B, 1C, 1D, 1E, 1F, 1G, 1H:
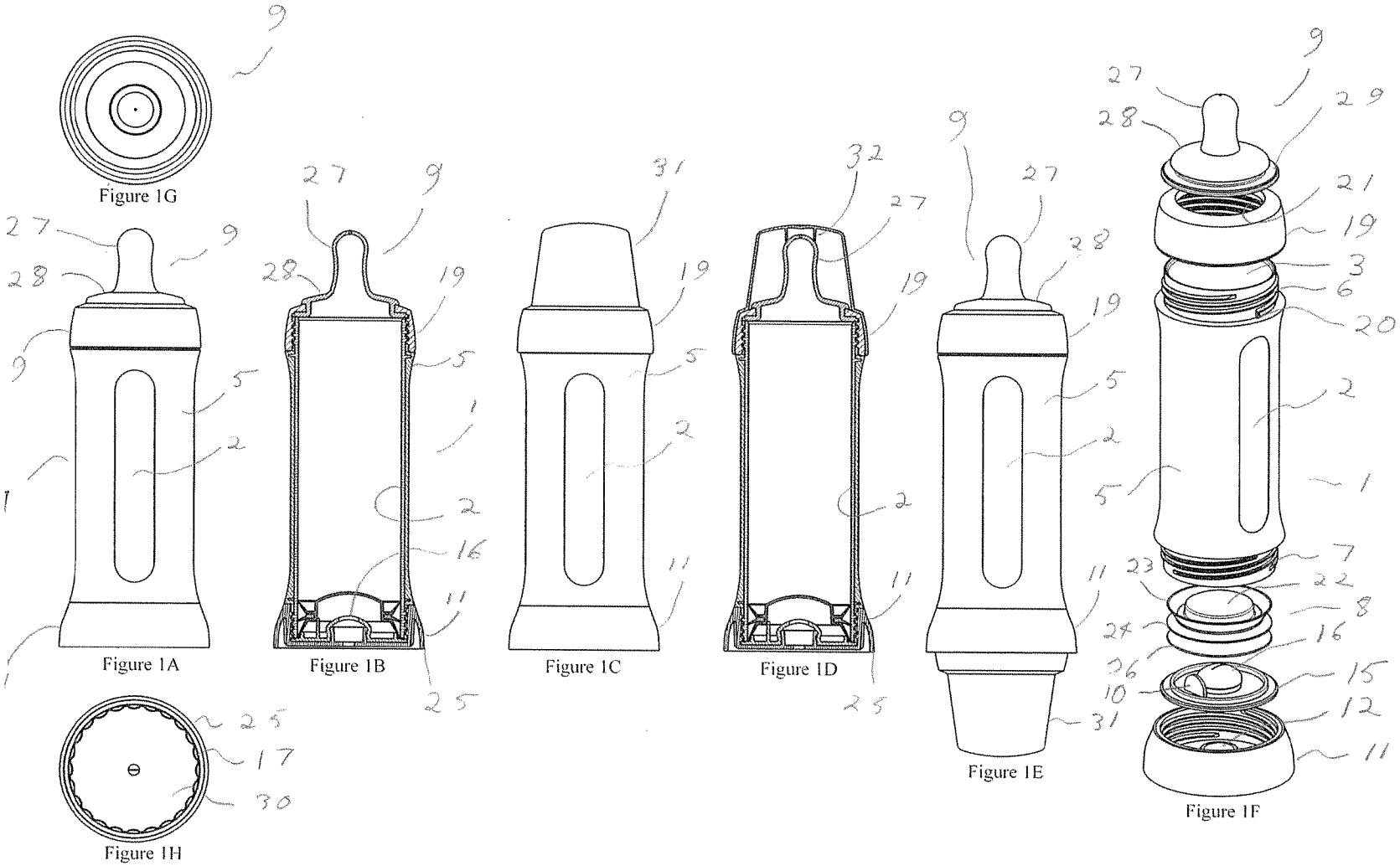
FIG. 1A is an elevational view of an embodiment of the invention.
FIG. 1B is a cross-sectional view of the embodiment of FIG. 1A.
FIGS. 1C and 1E are elevational views of preferred forms of the embodiment of FIG. 1A.
FIG. 1D is a cross-sectional view of the embodiment of FIG. 1C.
FIG. 1F is an exploded view of the embodiment of FIG. 1A.
FIG. 1G is a top view of the embodiment of FIG. 1A.
FIG. 1H is a view from below of the embodiment of FIG. 1A.

The embodiments of the feeder 1 that are illustrated in FIGS. 1A to 1G comprise: a base cap 11, a valve carrier 14, a movable bung 8, a tube 2, a teat mouthpiece 9 and an upper collar 19.

Although the tube 2 of FIGS. 1A to 1F is circular in cross-section, it may have any cross-section, so long as that cross-section is substantially constant throughout its entire length. The tube 2 has upper and lower open ends 3 and 4 and carries screw threads 6 and 7 adjacent those upper and lower ends. Although the screw threads 6 and 7 of FIGS. 1A to 1G are external to the tube 2, those screw threads may be internal to the tube 2. An over-moulding 5 encases a substantial portion of the exterior surface of the tube 2 between the upper and lower screw threads 6 and 7. The lower end of the upper screw thread 6 terminates in a thread stop 20 to aid in the orientation of components which are mounted on that screw thread.

The tube 2 of FIGS. 1A to 1F is symmetrical, in the sense that the screw threads 6 and 7 are identical. According to alternative embodiments of the invention which are not illustrated in the drawings, the feeder 1 is constructed so that it is not symmetrical in this sense so that the user may identify different "top" and "bottom" ends. The identification of different "top" and "bottom" ends of the tube 2 is useful in the case where the tube 2 is marked with a scale to indicate the volume of the contents of the feeder 1.

The moveable hung 8 is moveable longitudinally within the tube 2 and comprises a top 22, an upper blade 23, an intermediate blade 24 and a lower blade 26. Each of the blades 23, 24 and 26 extends around the periphery of the bung 8 and extends radially from the bung 8. The tolerances between the movable bung 8 and the inner surface of the tube 2 are such as to form a sliding seal between the movable bung 8 and the tube 2. The movable bung 8 is preferably constructed of a plastics polymer with a rubber over-mould to create a seal and to provide friction with the tube 2. This friction helps to support the movable bung 8 from moving downward. The top 22 of the movable bung 8 is shaped substantially to complement the underside of the teat mouthpiece 9. This helps to reduce the amount of contents left in the tube 2 when the movable bung 9 has reached the top of the tube 2 and is resting hard up against the underside of the mouthpiece 9. The blades 23, 24 and 26 around the movable hung 8 scrape along the inside wall of the tube 2 as the movable bung 8 moves up towards the mouthpiece 9, leaving virtually none of the contents behind.

A base cap 11 is mounted at the lower open end 4 of the tube 2 and prevents the movement of the bung 8 out of that end. For this purpose the base cap 11 carries an internal screw thread 18 which matches the external screw thread 7 of the tube 2. The base cap 11 is pierced by a an air hole 12.

The base cap 11 also retains a valve carrier 14 in place over the lower open end 4 of the tube 2. The valve carrier 14 has a peripheral region 15, a valve 16 and a pull-tab 10. Preferred forms of the valve 16 include a "dome valve" and a "sphere valve". As is illustrated in the drawings, a dome valve (such as valve 16 as is illustrated in the drawings) comprises a dome portion the periphery of which is contiguous with a cylindrical portion. A sphere valve is not illustrated in the drawings but it comprises a portion which is substantially more than half of a hollow sphere, the periphery of which is contiguous with a cylindrical portion. A dome valve accordingly has a shallower shape compared to the spherical valve. The functional difference between the two valves is that the spherical valve is significantly stronger than is the dome valve with regards to back pressure.

The valve 16 is in alignment with the air hole 12 in the base cap 11. It permits the ready flow of air from the exterior of tube 2 into the interior of that tube and substantially prevents the flow of air in the opposite direction. The air is then trapped in the tube 2 by the one-way valve 16, keeping the bung 8 in place by not allowing it to fall downward. The pull-tab 10 enables easy removal of the valve carrier 14, such as for cleaning. As is shown if FIG. 1H, the base cap 11 comprises an outer peripheral skirt 25 which surrounds the periphery of a central body 30. The periphery of the central body 30 is formed into longitudinally-running channels 17.

An upper collar 19 has an internal screw thread 21 which matches the external screw thread 6 of the tube 2. The upper collar 19 retains a teat mouthpiece 9 in place over the upper open end 3 of the tube 2. The teat mouthpiece 9 has a teat 27 which projects outwardly from the mouthpiece base 28 and the peripheral area of the base 28 is gripped between the tube 2 and the upper collar 19. The teat 27 is pierced or slit in the known manner of teats for baby feeding bottles.

As is illustrated in FIGS. 1C, 1D and 1E, it is preferred to provide a cap 31 which can be placed over the teat mouthpiece 9 for protection and to aid in the prevention of spillages. A substantially cylindrical protrusion 32 depends from the inner top surface of the cap 31 to hold an upper region of the teat 27. The cylindrical protrusion 32 seals off around the teat to reduce the risk of the spillage of material from the teat. The cap 31 is detachably held in place by being an interference fit over the upper collar 19. As is illustrated in FIG. 1E, the cap 31 can be stored adjacent the lower end 4 of the tube 2 by retention between the outer skirt 25 and the central body 30 of the base cap 11. The channels 17 in the central body 30 allow air to flow from the exterior, around the edge of the cap 31 and through the air hole 12 into the tube 2.

Figure 2C:
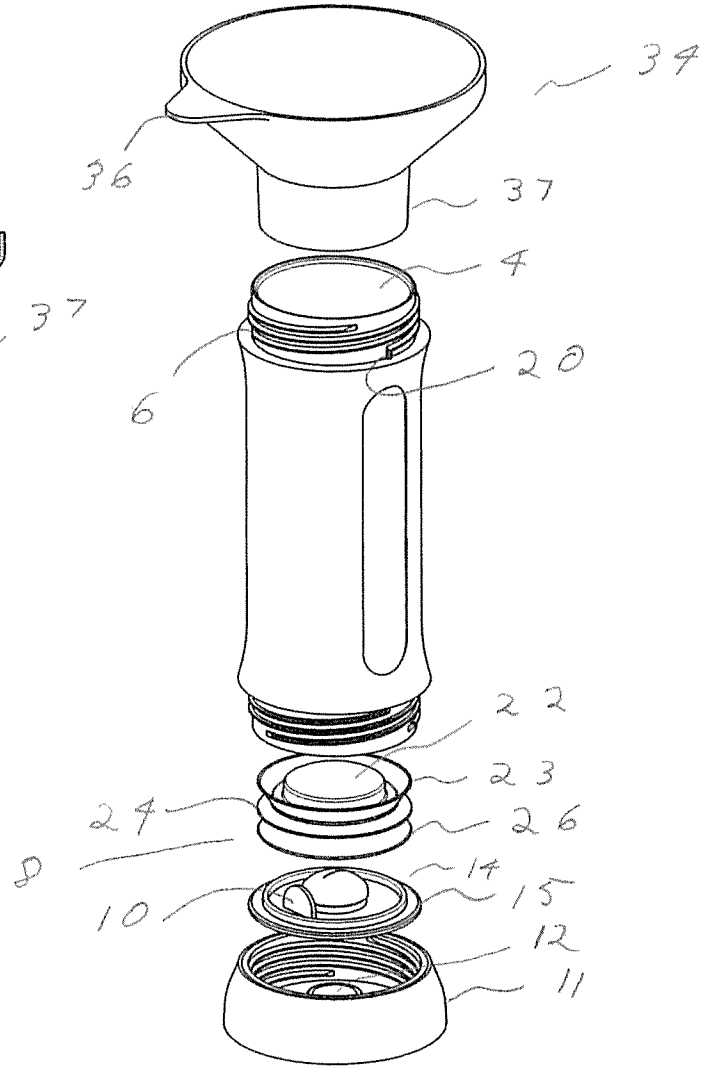
FIG. 2C is an exploded view of the embodiment of FIG. 2A.
Figure 2B:
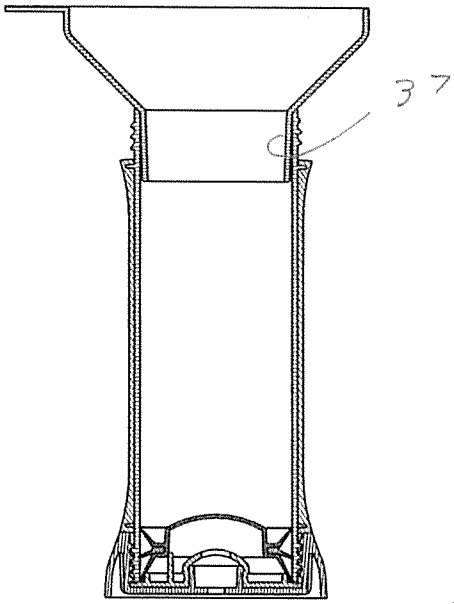
FIG. 2B is a cross-sectional view of the embodiment of FIG. 2A.
Figure 2A:
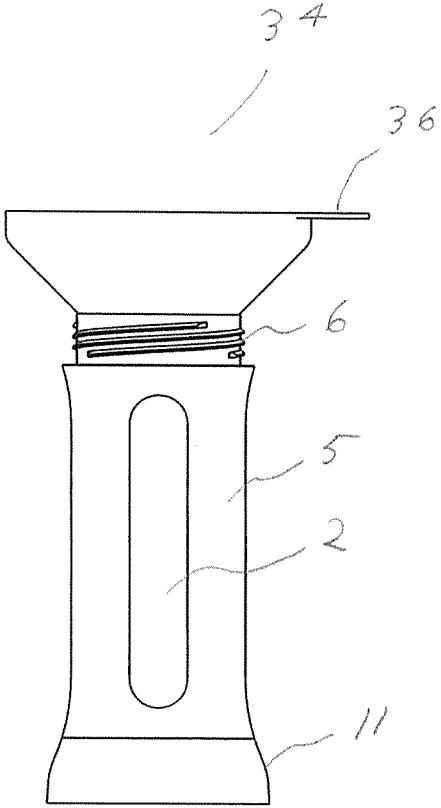
FIG. 2A is an elevational view of an embodiment of the invention.
Figures 3A, 3B, 3C, 3D, 3E, 3F, 3G:
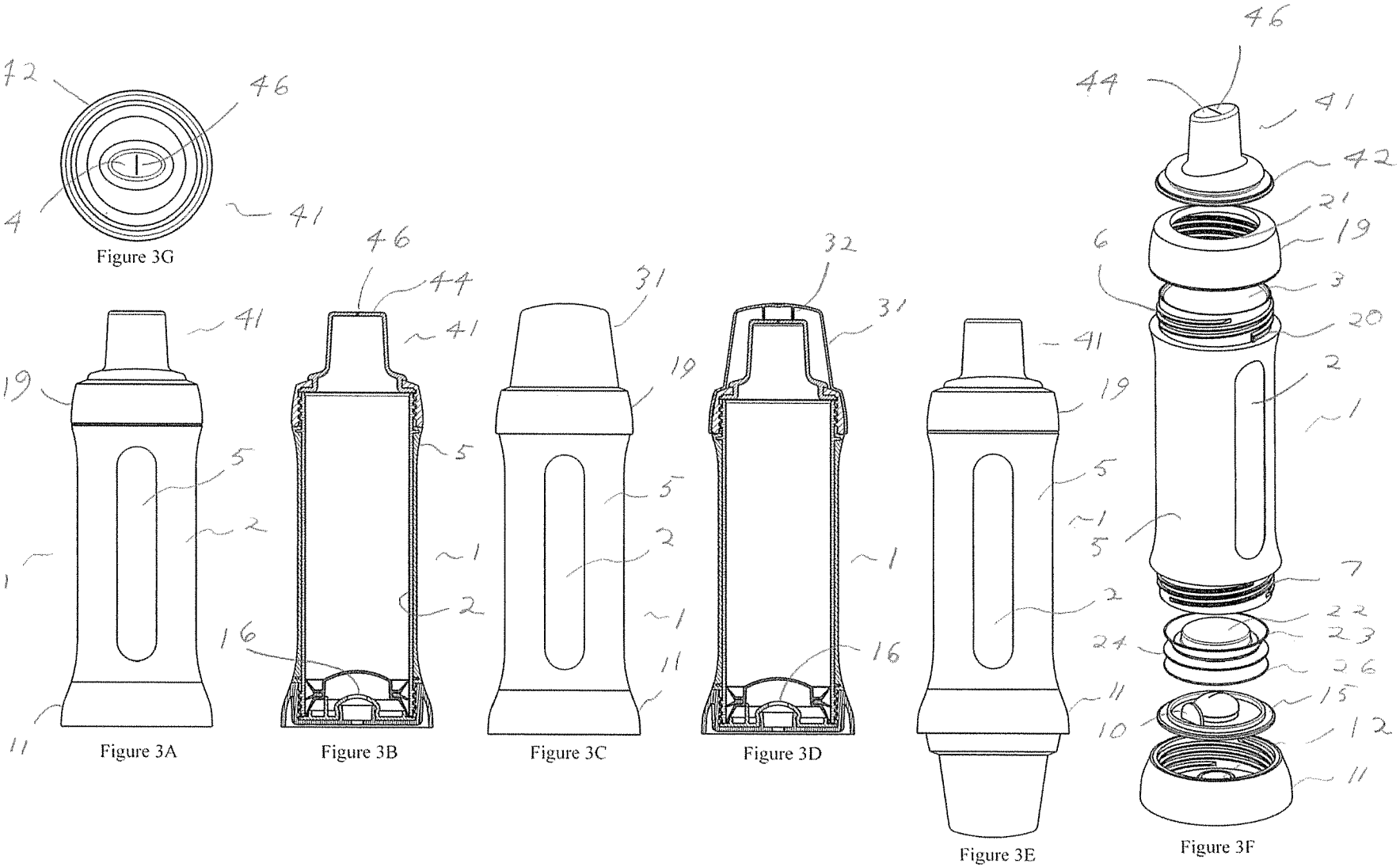
FIG. 3A is an elevational view of an embodiment of the invention.
FIG. 3B is a cross-sectional view of the embodiment of FIG. 3A.
FIGS. 3C and 3E are elevational views of preferred forms of the embodiment of FIG. 3A.
FIG. 3D is a cross-sectional view of the embodiment of FIG. 3C.
FIG. 3F is an exploded view of the embodiment of FIG. 3A.
FIG. 3G is a top view of the embodiment of FIG. 3A.
Figure 4F:
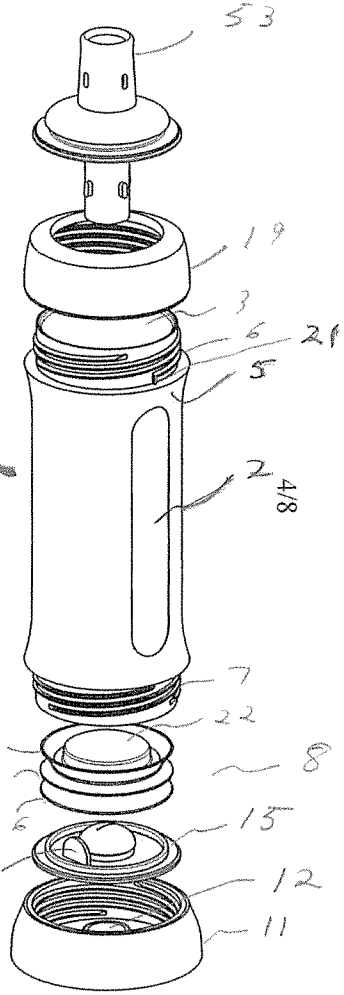
FIG. 4F is an exploded view of the embodiment of FIG. 4A.
Figure 4E:
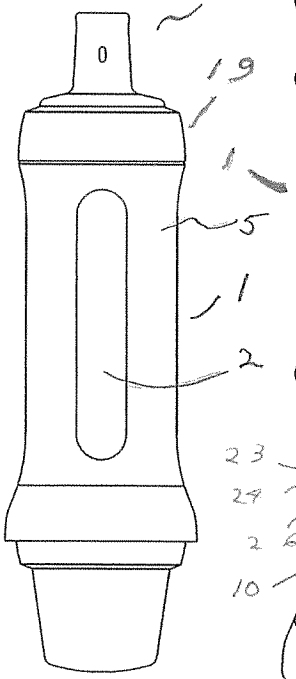
FIGS. 4C and 4E are elevational views of preferred forms of the embodiment of FIG. 4A.
Figure 4D:
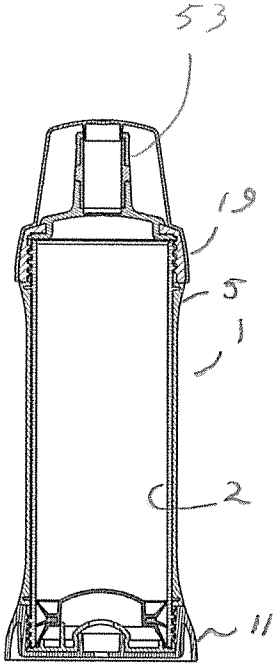
FIG. 4D is a cross-sectional view of the embodiment of FIG. 4C.
Figure 4C:
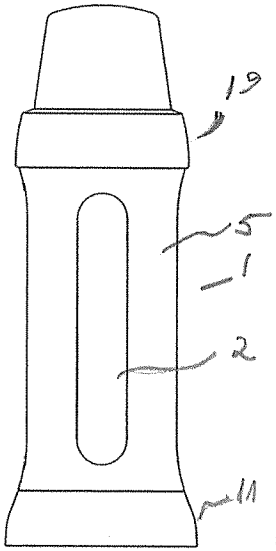
Figure 4B:
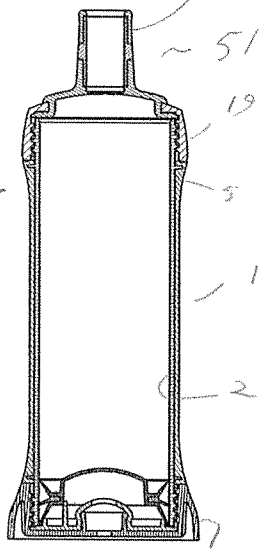
FIG. 4B is a cross-sectional view of the embodiment of FIG. 4A.
Figure 4A:
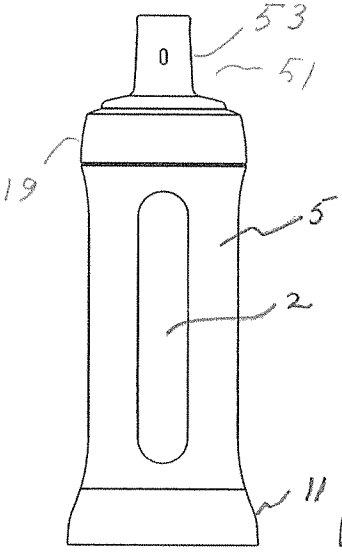
FIG. 4A is an elevational view of an embodiment of the invention.
Figure 4G:
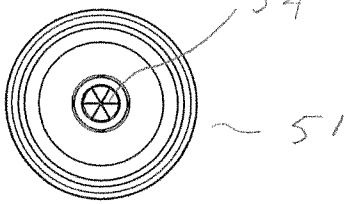
FIG. 4G is a top view of the embodiment of FIG. 4A.
Figure 5E:
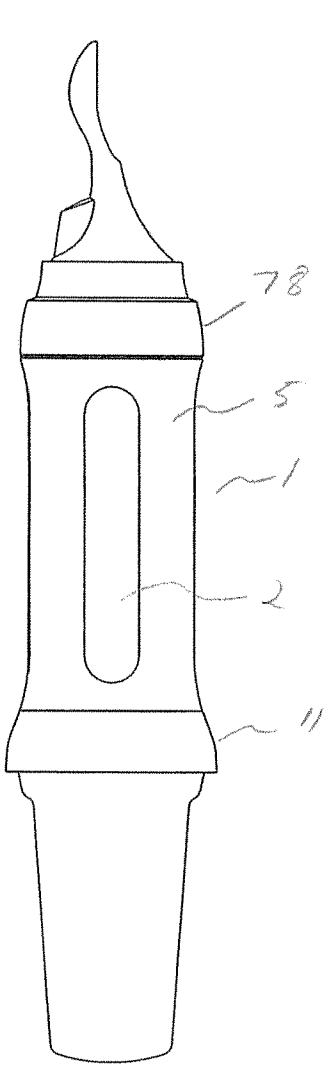
FIGS. 5C and 5E are elevational views of preferred forms of the embodiment of FIG. 5A.
Figure 5D:
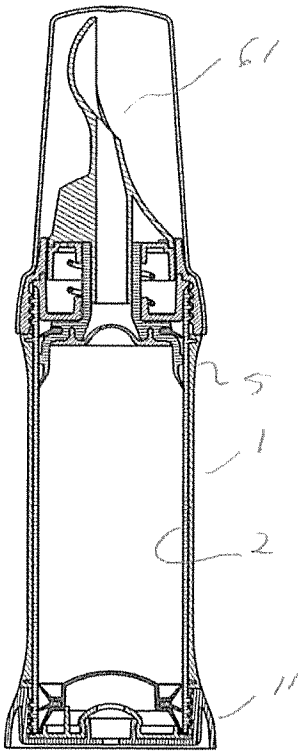
FIG. 5D is a cross-sectional view of the embodiment of FIG. 5C.
Figure 5C:
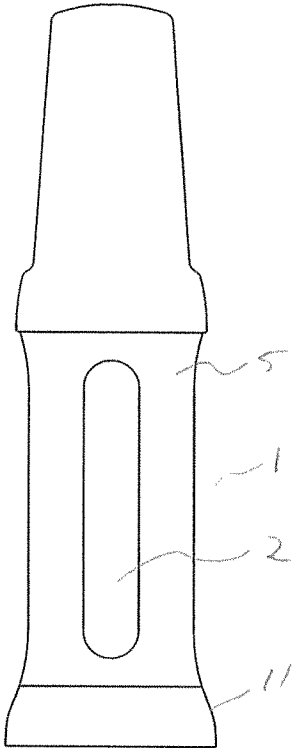
Figure 5B:
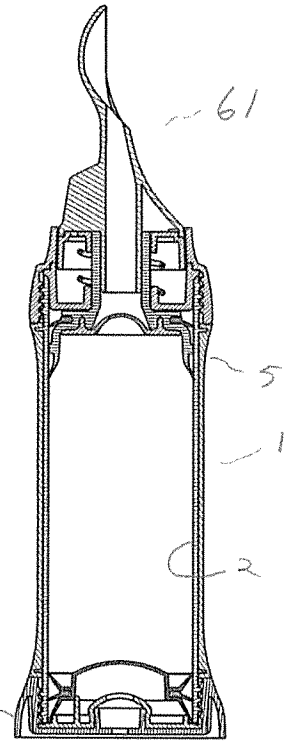
FIG. 5B is a cross-sectional view of the embodiment of FIG. 5A.
Figure 5G:
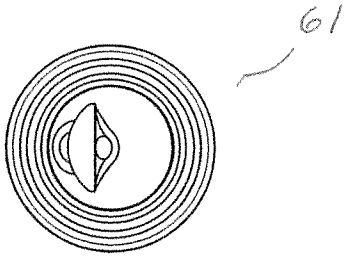
FIG. 5G is a top view of the embodiment of FIG. 5A.
Figure 5A:
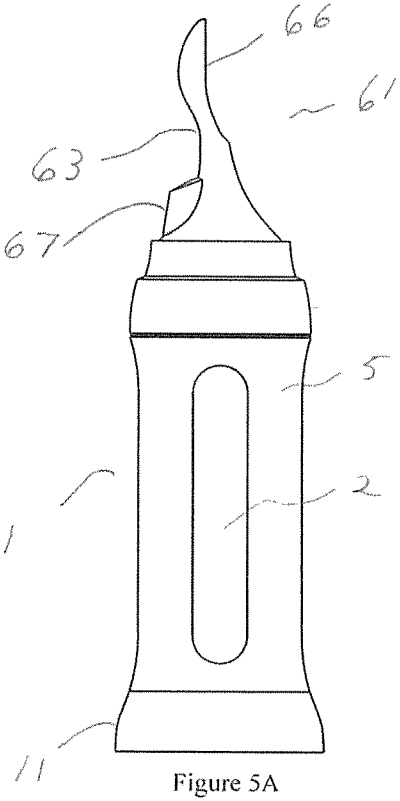
FIG. 5A is an elevational view of an embodiment of the invention.
Figure 5F:
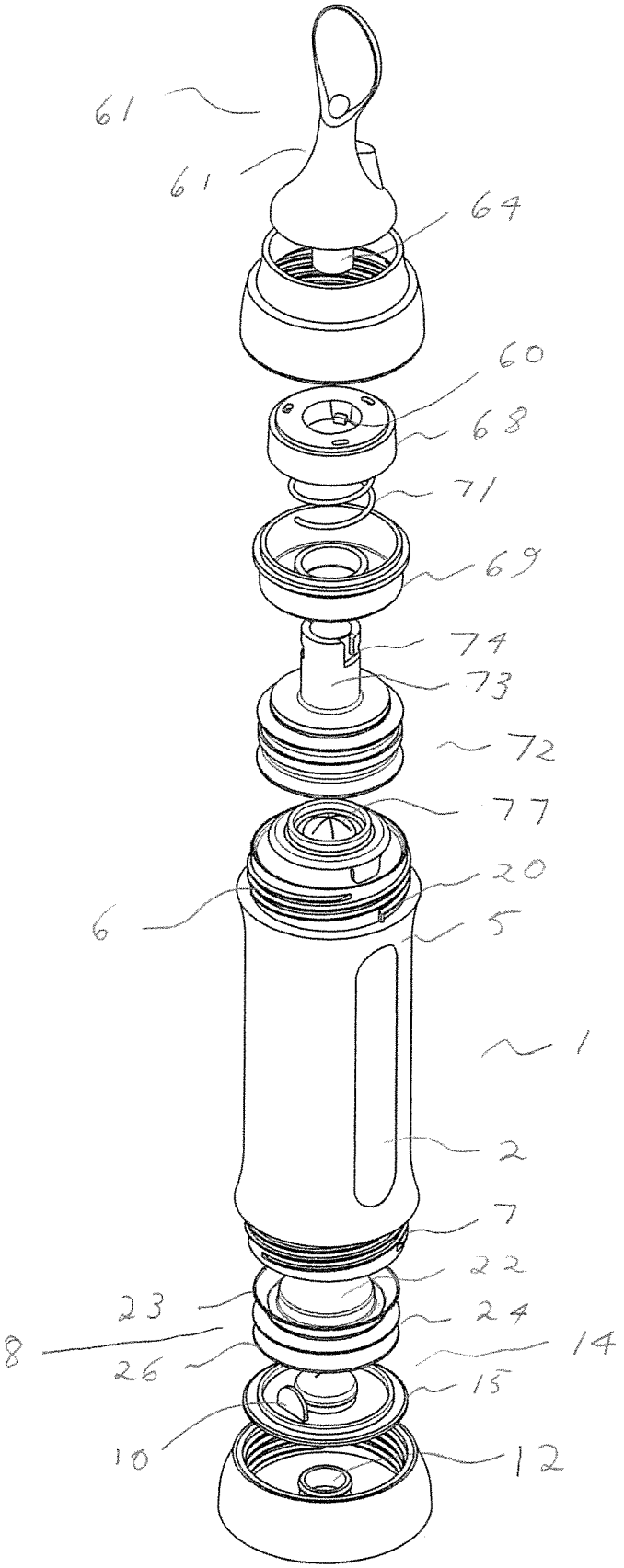
FIG. 5F is an exploded view of the embodiment of FIG. 5A.
Figure 6A:
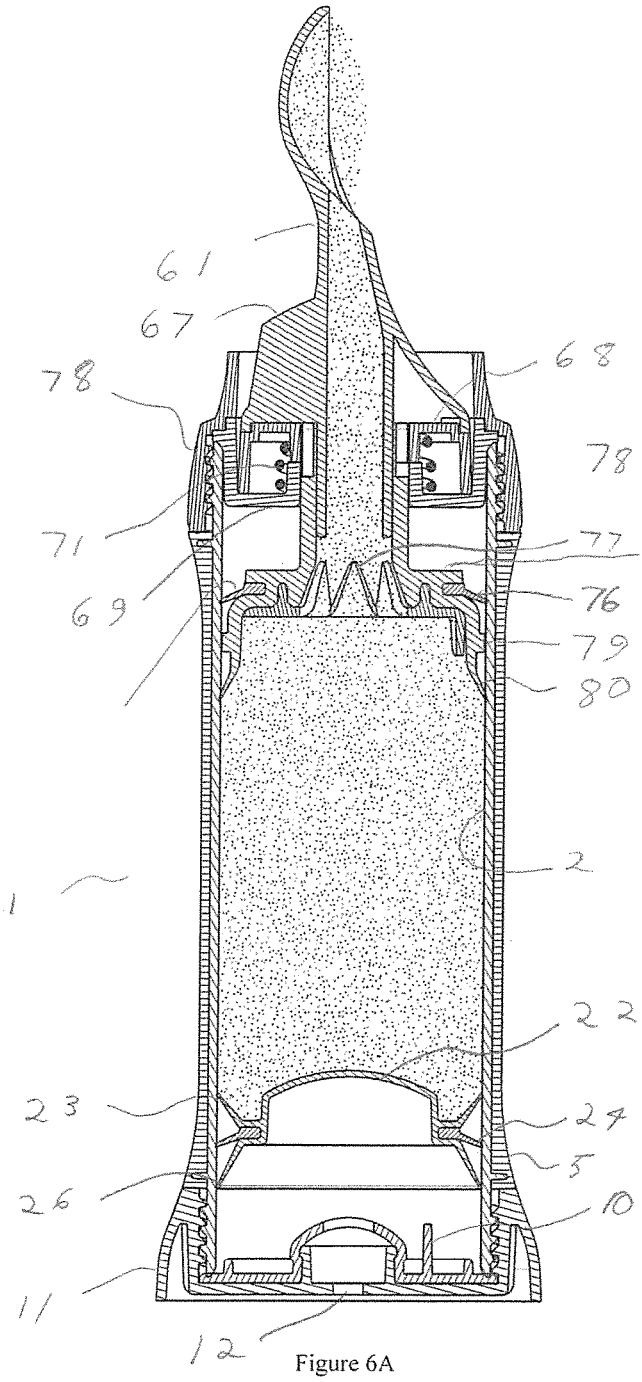
FIGS. 6A and 6B are cross-sectional views illustrating aspects of the operation of the embodiment of FIG. 5A.
Figure 6B:
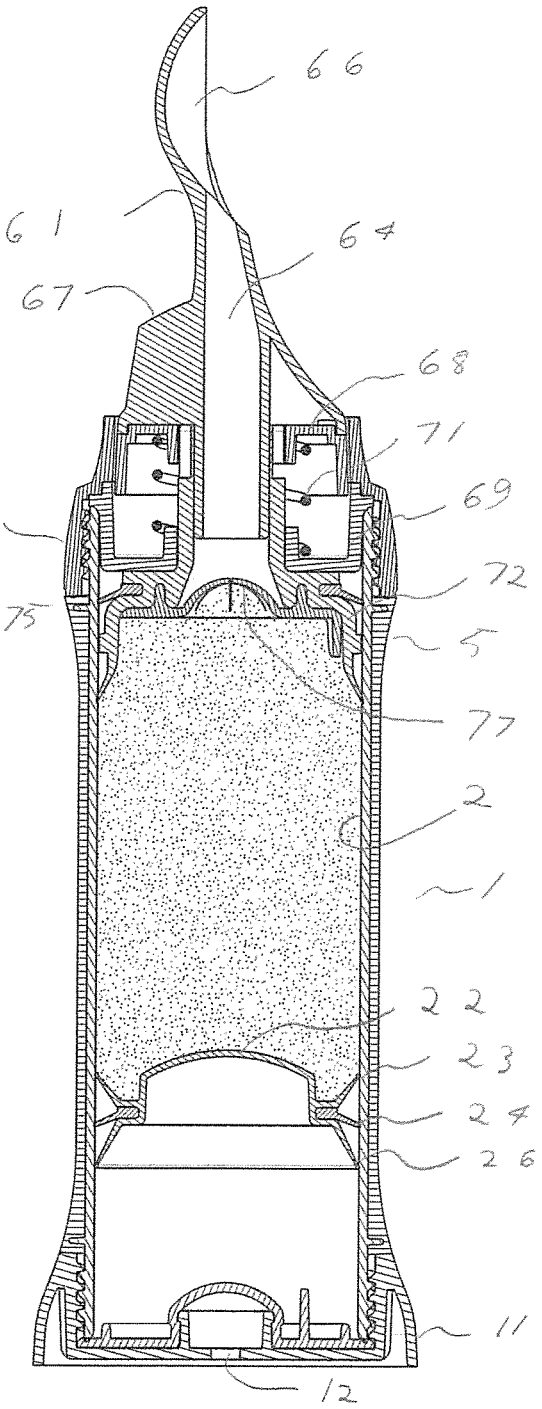
Figure 7C:
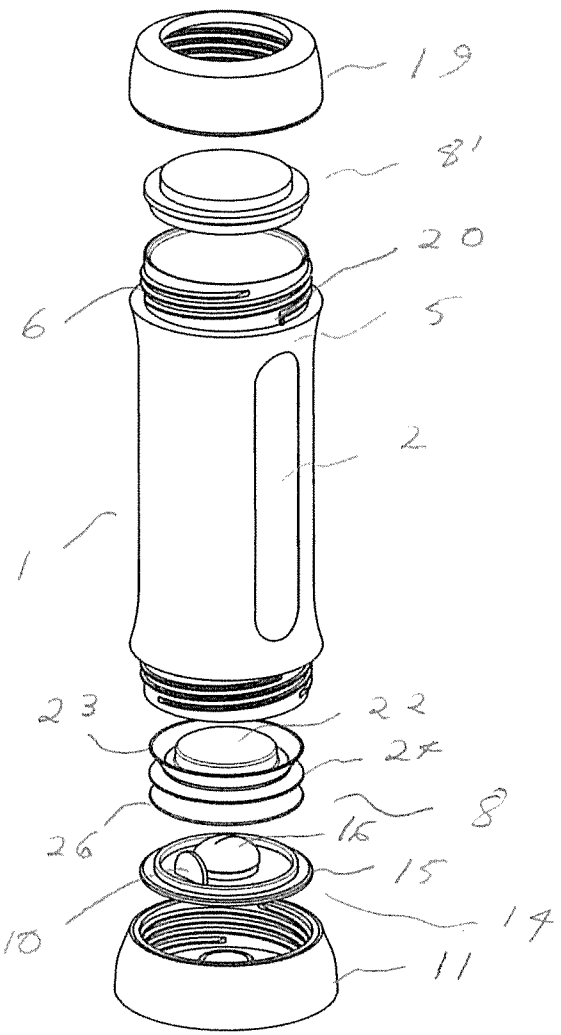
FIG. 7C is an exploded view of the embodiment of FIG. 7A.
Figure 7B:
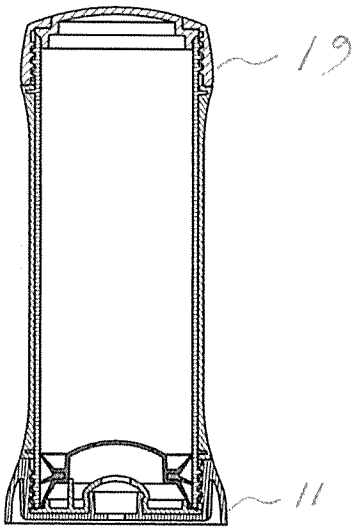
FIG. 7B is a cross-sectional view of the embodiment of FIG. 7A.
Figure 7D:
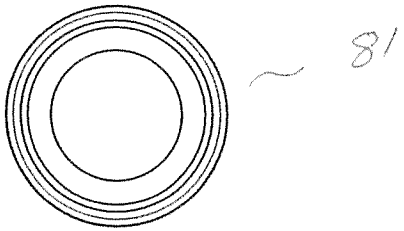
FIG. 7D is a top view of the embodiment of FIG. 7A.
Figure 7A:
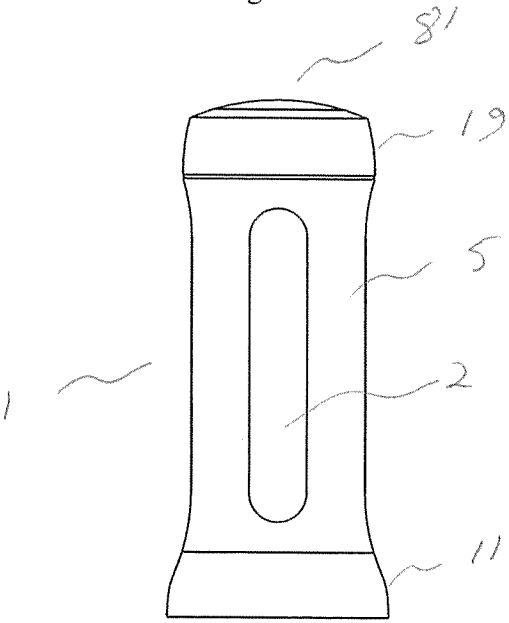
FIG. 7A is an elevational view of an embodiment of the invention.

As is illustrated in FIGS. 2A to 2C, it is preferred to provide a funnel 34 to aid in the loading of material into the feeder 1. The funnel 34 has a handle 36 which protrudes from the upper periphery of the funnel. It is preferred that the stem 37 of the funnel be a close fit within the upper open end 3 of the tube 2.

The embodiments of the invention that are illustrated in FIGS. 3A to 3G differ from the embodiments of FIGS. 1A to 1G in that the teat mouthpiece 9 has been replaced by a sipper mouthpiece 41. The sipper mouthpiece 41 is hollow and comprises a base 42 from which extends a sipper body 43 which is preferably substantially elliptical in cross-section and which terminates in a blunt end 44. The blunt end 44 is pierced by a slit 46 which extends across an axis of that end and operates in the same manner as do teats for baby feeding bottles.

The embodiments of the invention that are illustrated in FIGS. 4A to 4G differ from the embodiments of FIGS. 1A to 1G in that the teat mouthpiece 9 has been replaced by a spout mouthpiece 51. The spout mouthpiece 51 comprises an open-ended spout 53 which extends upwardly from a base 52. A valve 54 in the base 52 allows for one-way flow of material from the tube 2 into the spout 53. The purpose the valve 54 is to prevent contents of the feeder 1 from spilling out when the feeder is on its side or upside down. This valve is designed to be weaker than the one-way air valve 16 located in the movable bung 8, to enable the contents of the feeder 1 to dispense smoothly.

The embodiments of the invention that are illustrated in FIGS. 5A to 5G differ from the embodiments of FIGS. 1A to 1G in that the teat mouthpiece 9 has been replaced by a spoon pump attachment 61.

The spoon pump attachment 61 allows parents to feed their infants single-handedly, whilst also promoting utensil education for the infant.

The spoon pump attachment 61 comprises a spoon 63 and a pump. The pump is dimensioned to dispense just enough contents to fill the spoon 63. The spoon 63 comprises a spoon head 68 and a spoon tube 64 so that the spoon head 68 is in communication with the hollow interior of the spoon tube 64. A spoon trigger 67 projects substantially radially from the spoon tube 64. The pump comprises the top cap pump pack 68, the helical spring 71, the pump bung 72 and the pump one way valve 77. The structure and function of the various components of the of the spoon pump attachment are as follows Spoon Top Cap 62

A spoon top cap 62 snap fits onto the feeder 1, protecting the spoon 63 when it is not in use. It can also be clipped into the base cap 11 during use.

Spoon 63

The spoon 63 clips onto the top cap pump pack 68. It has a tube 64 that fits into the pump bung 72 and opens onto the spoon head 66. The contents of the feeder 1 will travel through the tube 64 onto the spoon head 66. Underneath the tube 64 at the back of the spoon head 66 is the spoon trigger 67 where the user applies pressure to engage the pump mechanism.

Top Cap Pump Pack 68

A top cap pump pack 68 is fitted to the pump bung 72 with a quick release bayonet fitting. The bayonet fitting comprises the bayonet slots 74 in the pump bung tube 73 and corresponding projections 60 within the top cap pump pack 68. Together with the spring stop 69 it houses the spring 71. The top of the pump bung 72 and the tube 64 of the spoon run through the middle of the top cap pump pack 68, spring 71 and spring stop 69.

Spring 71

The coil spring 71 is fitted to the spring stop 69 and housed in the top cap pump pack 68. Its purpose is to return the spoon 63, top cap pump pack 68 and pump bung 72 back to its original position.

Spring Stop 69

The spring stop 69 is fastened to the feeder tube 2 by the pump collar 68. Its purpose is to house the spring 71 and attach the pump mechanism to the tube 2.

Pump Collar 78

The threaded pump collar 78 fastens the spoon pump attachment 61 to the tube 2. It has an extended collar that reaches above the top cap pump pack 68 to the base of the spoon attachment 61 in order to protect the user from pinching skin when pumping the spoon attachment 61.

Pump Bung 72

The top of the pump bung 72 is a tube 73 that attaches to the top cap pump pack 68. The tube 64 of the spoon fits into the tube 73 at the top of the pump bung 72. The pump one-way valve 77 clips into the base of the pump bung tube 73. The pump bung 72 comprises a body 75 which receives a radially-extending circumferential seal 76. The outer periphery of the seal 76 forms a sliding seal with the internal wall of the tube 2. A radially-extending location/alignment ring 79 is integrally formed with the body 75 below the circumferential seal 76 and a radially extending scraper/seal blade 80 is integrally formed with the body 75 below the location/alignment ring 79. The circumferential seal 76, the location/alignment ring 79 and the scraper/seal blade 80 result in the pump bung 72 fitting tightly within, and sealing with, the tube 2.

When downward pressure is applied to the spoon trigger 67, the pump bung 72 will move downward inside the feeder tube 2. The contents will be force to squeeze through the pump one way-valve 77 out through the spoon tube 64 onto the spoon head 66.

Pump One-Way Valve 77

The pump one way valve 77 clips into the base of the pump bung tube 73. The pump one way valve 77 allows the contents of the feeder 2 to squeeze out onto the spoon 63, but will not allow the contents to be sucked back into the tube 2. The pump one way valve 77 is designed to be weaker than the one way valve 16 which is fitted at the bottom of the feeder. This will allow a smoother feed of the contents dispensing, rather than a squirt.

The embodiments of the invention that are illustrated in FIGS. 7A to 7D differ from the embodiments of FIGS. 1A to 1G in that the teat mouthpiece 9 has been replaced by a storage cap 81. The storage cap 81 fits onto the top of the tube 2 and is held in place by the upper collar 19. The storage cap 81 is intended for use on the tops of spare feeders and for the storage of feeders during travel or in refrigerators or in coolers.

The different mouthpieces are designed to accommodate different textures of materials. The teat mouthpiece 9 accommodates liquids, such as milk, water and juices. The sipper mouthpiece 41 accommodates purees, such as pureed vegetables, fruits, cereals, smoothies and yoghurt. The spout mouthpiece 51 accommodates mashes, such as mashed vegetables, fruits, proteins, and chunky soups.

The spoon pump attachment is designed to allow parents to feed their infants single-handedly, while also promoting utensil education for the infant. The spring-loaded pump is regulated to dispense just enough contents to fill the attached spoon.

The presently-described embodiments of the invention are manufactured in any suitable material by any suitable process, but particularly preferred materials and processes for various components are set out in the following table.

| Component | Process | Material |
|---|---|---|
| 1 Tube 2 | Injection moulding | Tritan copolyester |
| 2 Over-moulding 5 | Over moulding | ABS (Acrylonitrile butadiene styrene) |
| 3 Bung 8 | Injection moulding | Polyurethane |
| 4 Teat 9 | Injection moulding | Silicones |
| 5 Base cap 11 | Injection moulding | ABS |
| 6 Valve 16 | Injection moulding | Polyurethane |
| 7 Collar 19 | Injection moulding | ABS |
| 10 Top cap 31 | Injection moulding | Tritan copolyester |
| 11 Funnel 34 | Injection moulding | ABS |
| 12 Sipper mouthpiece 41 | Injection moulding | Polyurethane |
| 13 Spout mouthpiece 51 | Over moulding | Polyurethane |
| 14 Spoon 63 | Injection moulding | Polyurethane |
| 15 Spring stop 15 | Injection moulding | ABS |
| 16 Pump Bung 72 | Injection moulding | HDPE (high-density polyethylene) |
| 17 Pump one-way valve 77 | Injection moulding | Polyurethane |
| 18 Pump collar 78 | Injection moulding | ABS |
| 19 Storage cap | Injection moulding | ABS |

While the present invention has been described with reference to a few specific embodiments, the description is illustrative of the invention and is not to be construed as limiting the invention. Various modifications may occur to those skilled in the art without departing from the true spirit and scope of the invention as defined by the appended claims. As the present invention may be embodied in several forms without departing from the spirit of the essential characteristics of the invention, it should be understood that the above described embodiments are not to limit the present invention unless otherwise specified, but rather should be construed broadly within the spirit and scope of the invention as defined in the appended claims. The described embodiments are to be considered in all respects as illustrative only and not restrictive. Various modifications and equivalent arrangements are intended to be included within the spirit and scope of the invention and appended claims. Therefore, the specific embodiments are to be understood to be illustrative of the many ways in which the principles of the present invention may be practiced. In the following claims, any particular means-plus-function clauses are intended to cover structures as performing the defined function and not only structural equivalents, but also equivalent structures. For example, although a nail and a screw may not be structural equivalents in that a nail employs a cylindrical surface to secure wooden parts together, whereas a screw employs a helical surface to secure wooden parts together, in the environment of fastening wooden parts, a nail and a screw are equivalent structures.

A reference to any prior art in this specification is not, and should not be taken as, an acknowledgment or any form of suggestion that the referenced prior art forms part of the common general knowledge in Australia. Accordingly, it is to be appreciated that any discussion of documents, devices, acts or knowledge in this specification is included to explain the context of the present invention. Further, the discussion throughout this specification comes about due to the realisation of the inventor and/or the identification of certain related art problems by the inventor. Moreover, any discussion of material such as documents, devices, acts or knowledge in this specification is included to explain the context of the invention in terms of the inventor's knowledge and experience and, accordingly, any such discussion should not be taken as an admission that any of the material forms part of the prior art base or the common general knowledge in the relevant art in Australia, or elsewhere, on or before the priority date of the disclosure and claims herein.

Throughout this specification the use of the word "inventor" in singular form may be taken as reference to one (singular) inventor or more than one (plural) inventor of the present invention.

Throughout this specification, the words "comprise", "comprised", "comprising" and "comprises" are to be taken to specify the presence of stated features, integers, steps or components but does not preclude the presence or addition of one or more other features, integers, steps, components or groups thereof.

In the claims, each dependent claim is to be read as being within the scope of its parent claim or claims, in the sense that a dependent claim is not to be interpreted as infringed unless its parent claims are also infringed.

We claim:

1. A kit of parts for a dispenser of material, comprising:
- a tubular body of substantially invariant internal cross-sectional shape;
- a bung which:
  - is adapted to slide within the tubular body; and
  - is integrally formed with a periphery which is adapted to form sliding seals between that periphery and the internal side walls of the tubular body, wherein the periphery comprises an over-moulded radially-extending circumferential seal and an over-moulded radially-extending scraping and sealing blade; extending outward at a different angle from said circumferential seal; and
- a base cap having an aperture through it, the base cap being adapted:
  - for mounting at a first end of the tubular body so as to substantially occlude that end; and
  - to allow airflow through the aperture into the tubular body as the bung moves in a direction away from the first end of the tubular body; and
- a valve which is mountable to the base cap to permit airflow only in the direction from the exterior of the tubular body to the interior of the tubular body in use,
- wherein the valve comprises a portion which is substantially more than half of a hollow sphere, the periphery of which is contiguous with a cylindrical portion of the valve.

2. A kit of parts as claimed in claim 1, further comprising at least one mouthpiece attachment which is adapted for readily-detachable mounting to a second end of the tubular body and in which the material is food or drink.

3. A kit of parts as claimed in claim 2, in which the at least one mouthpiece attachment is one of:
- a teat mouthpiece which is adapted to allow the flow of a liquid through it;
- a sipper mouthpiece which is adapted to allow the flow of pureed material through it; and
- a spout mouthpiece which is adapted to allow the flow of mashed material through it.

4. A kit of parts as claimed in claim 3, in which the sipper mouthpiece comprises a body which has a blunt end which is pierced by a slit in that blunt end.

5. A kit of parts as claimed in claim 3, in which the spout mouthpiece comprises:

a base;

an open-ended spent which extends from the base; and a valve in the base which allows flow of material into the spout.

6. A kit of parts as claimed in claim 1, further comprising a pump attachment, the pump attachment comprising a pump which is adapted for readily-detachable mounting to the second end of the tubular body and which is adapted to pump material out of the tubular body.

7. A kit of parts as claimed in claim 6, in which the pump attachment further comprises a spoon which is mounted on the pump attachment and which is adapted to receive material which the pump pumps out of the tubular body.

8. A kit of parts as claimed in claim 6, in which the pump comprises:

a pump bung which:

is adapted for reciprocating movement along the longitudinal axis of the tubular body; and has a periphery which is adapted to form a sliding seal between that periphery and the internal side walls of the tubular body;

a valve which is adapted to allow the flow of material from the interior of the tubular body as the pump bung moves into the pump body but to prevent the flow of material into the interior of the tubular body as the pump bung moves out of the pump body; and biasing means to bias the pump bung to move in a direction out of the pump body.

9. A kit of parts as claimed in claim 8, in which the biasing means is mounted in a housing which comprises:

a spring stop relative to which the pump bung is longitudinally moveable; and a spring top cap:

relative to which the pump bung is fixed; and which is reciprocally moveable within the spring stop.

10. A kit of parts as claimed in claim 8, in which the pump attachment further comprises a pump tube which is adapted to deliver material from the outlet of the valve which is adapted to allow the flow of material from the interior of the tubular body to the spoon.

11. A kit of parts as claimed in claim 10 in which the spring stop and the spring top cap are mounted substantially co-axially around the pump tube.

12. A kit of parts as claimed in claim 1, further comprising a top cap which is mountable to the dispenser to cover at least one of a mouthpiece attachment and the pump attachment.

13. A kit of parts as claimed in claim 12, in which the base cap is adapted to serve as a mounting for the top cap so as not to substantially occlude the airflow through the aperture into the tubular body.

14. A kit of parts as claimed in claim 13, in which the base cap comprises:

a central body, the periphery of which carries longitudinally-running channels; and an outer peripheral skirt which surrounds the periphery of the central body, the base cap being adapted to receive a peripheral edge of the top cap between the longitudinally-running channels and the outer peripheral skirt.

15. A kit of parts as claimed claim 1, further comprising:

a valve which is mountable at the second end of the tubular body so as to permit the flow of material only in the direction from the interior of the tubular body to the exterior of the tubular body.

16. A kit of parts as claimed in claim 1, in which the periphery which is adapted to form the sliding seal comprises a radially-extending locating and alignment ring which is located between the radially-extending circumferential seal and the radially-extending locating and alignment ring.

17. A kit of parts as claimed in claim 16, in which the radially-extending circumferential seal is formed separately from the bung.

18. A kit of parts as claimed in claim 16, in which the radially-extending locating and alignment ring is formed integrally with the bung.

19. A dispenser of material, assembled from the kit of parts which is claimed in claim 1.

* * * * *